United States Patent [19]

Stefnik et al.

[11] Patent Number: 4,667,450

[45] Date of Patent: May 26, 1987

[54] UNITIZED PARTITION SYSTEM

[76] Inventors: William S. Stefnik, 955 Lake Christina Way S.E., Calgary, Alberta, Canada, T2J 2R2; Frank J. Grims, 28 Deerwood Rd., S.E., Calgary, Alberta, Canada, T2J 6E1

[21] Appl. No.: 766,431

[22] Filed: Aug. 16, 1985

[30] Foreign Application Priority Data

Aug. 24, 1984 [CA] Canada ..... 461796

[51] Int. Cl.[4] ..... E04B 2/74

[52] U.S. Cl. ..... 52/238.1; 52/243.1; 52/476; 52/656

[58] Field of Search ..... 52/126.4, 586, 36, 243.1, 52/580, 806, 106, 238.1, 476, 477, 656, 239, 243.1, 827, 828

[56] References Cited

U.S. PATENT DOCUMENTS

| | | | |
|---|---|---|---|
| 1,219,208 | 3/1917 | Zahner et al. | 52/238.1 |
| 1,798,392 | 3/1931 | Adams | 52/126.4 |
| 2,893,076 | 7/1959 | Herts | 52/806 |
| 2,962,133 | 11/1960 | Kivett | 52/580 |
| 3,125,193 | 3/1964 | Brown et al. | 52/239 |
| 3,293,813 | 12/1966 | Emmons | 52/238.1 |
| 3,990,196 | 11/1976 | Eddins | 52/106 |
| 4,037,380 | 7/1977 | Pollock | 52/238.1 |
| 4,045,932 | 9/1977 | Bogert | 52/241 |
| 4,103,463 | 8/1978 | Dixon | 52/126.4 |
| 4,128,983 | 12/1978 | Matsubara . | |
| 4,356,672 | 11/1982 | Beckman | 52/36 |

FOREIGN PATENT DOCUMENTS

| | | |
|---|---|---|
| 500149 | 2/1934 | Canada . |
| 373408 | 4/1938 | Canada . |
| 651525 | 10/1962 | Canada . |
| 870859 | 5/1971 | Canada . |
| 872509 | 6/1971 | Canada . |
| 911123 | 10/1972 | Canada . |
| 951076 | 7/1974 | Canada . |
| 960427 | 1/1975 | Canada . |
| 998217 | 10/1976 | Canada . |
| 1015520 | 8/1977 | Canada . |
| 1080601 | 7/1980 | Canada . |
| 1110820 | 10/1981 | Canada . |

*Primary Examiner*—James L. Ridgill, Jr.

*Attorney, Agent, or Firm*—Berman, Aisenberg & Platt

[57] ABSTRACT

There is provided a new and useful unitized panel assembly for partition walls comprising a frame structure comprising in open rectangular configuration top, bottom, and first and second sides each comprising a hollow member of rectangular configuration, each hollow member having first and second panel support faces joined by inner and outer webs, the faces having inner and outer surfaces and inner and outer edges, the outer web being spaced from the outer edges, the outer surfaces having a flange extending perpendicular thereto at the outer edges, a pair of rectangular panels secured to the support surfaces, and wherein the panels are adapted to fit closely within the flanges, and the extremities of the flanges are substantially flush with the outer surface of the panels.

17 Claims, 16 Drawing Figures

UNITIZED PARTITION SYSTEM

This application relates to unitized panel assemblies for partition walls and to partition systems using the panel assemblies.

BACKGROUND OF THE INVENTION

Various types of partition systems have been developed over the years in an attempt to meet the needs of modern highrise office towers. Conventional drywall partitions initially offered advantages when compared with the older plaster walls. Conventional drywall construction, however, is totally inadequate for modern requirements.

Conventional drywall construction is labour intensive and, accordingly, the cost factor alone prohibits its use in large projects.

Equally significant in the highrise office tower situation is the need to have partition walls which can be disassembled and reassembled in different configurations to meet changing office requirements. It has been found that an average of fifteen per cent of the partitions in a highrise (office) tower must be moved each year.

Various systems have been developed in an attempt to meet cost and moveability criteria. To date, however, each such proposed system has suffered from a number of deficiencies. Furthermore, developing construction methods are continuously dictating additional requirements, so that older systems become progressively less satisfactory.

For example, it was formerly the case that partition walls were required to follow the grid system utilized in a modern suspended ceiling, so that the partition wall would be directly below the suspended T-bars of the ceiling. By contrast it is now highly desirable that alignment as between the T-bars and the partition walls be avoided. This arrangement allows the integrity of the T-bars to be maintained and not be broken, for example, by wiring or the like from the wall. This requirement has very important implications for the dimensions of modular systems, particularly at module joints and at partition wall corners.

In addition, aesthetic requirements have become increasingly more demanding. it can generally be said that the closer a partition system approaches conventional drywall partitions in appearance, the more acceptable it will be. The apprearance is generally enhanced by partition systems not readily displaying joints and the like in a straight run of wall and by improved finishing components.

Finally, while the moveability criteria has received attention in the design of present systems, those systems have been primarily directed toward the initial construction situation and are primarily governed by first cost considerations. As a secondary aspect, the moveability problem has received less attention, and this has led to difficulties. For example, present partition walls have generally affected cosmetics to the extent that ceilings, floors, and the like are often damaged by the walls and require repair or partial replacement when walls are moved. This adds to the time and expense of the moving process, and, in view of the significant amount of this activity required, as noted above, in a highrise office tower, the wall relocation cost factor is of major proportions.

It is against this background that the present invention arises. The panel assemblies and partition systems of the present invention have been specifically designed to taken into account problem areas in both first cost installations and in refits, but with emphasis on the refit aspect. Thus, while cost competitive at the construction stage, the new assemblies provide very significant advantages in the subsequent inevitable wall rearrangements.

PRIOR ART

A number of prior patents are of interest in a consideration of the present invention. For example, Canadian Pat. No. 960,427, granted Jan. 7, 1975, to Domtar Ltd., illustrates a non-progressive system based on wooden framed panels. This is primarily a first cost system which ilustrates significant disadvantages, particularly in the refit situation.

Canadian Pat. No. 373,408, granted Apr. 26, 1938, to Lindemann illustrates an earlier progressive system of some interest.

Other Canadian Patents of marginal interest are the following:

No. 500,149, Feb. 23, 1934, Nelsson
No. 651,525, Oct. 30, 1962, Young
No. 870,859, May 18, 1971, Moog
No. 872,509, June 8, 1971, Miller
No. 911,123, Oct. 3, 1972, Lickliter, et al.
No. 951,076, July 16, 1974, Scholey
No. 998,217, Oct. 10, 1976, Nelsson
No. 1,015,520, Aug. 16, 1977, Cuin
No. 1,080,601, July 1, 1980, Leeming, et al.
No. 1,110,820, Oct. 20, 1981, Wendt.

U.S. patents of interest are the following:

U.S. Pat. No. 1,219,208, Mar. 13, 1917, Zahner, et al.
U.S. Pat. No. 3,125,193, Mar. 17, 1964, Brown, et al.
U.S. Pat. No. 4,037,380, July 26, 1977, Pollock
U.S. Pat. No. 4,045,932, Sept. 6, 1977, Bogert
U.S. Pat. No. 4,128,983, Dec. 12, 1978, Matsubara.

SUMMARY OF THE INVENTION

The panel assemblies of the present invention include a unique framing system which affords a high degree of protection to the panels making up the assemblies. Combined with other elements for incorporating the assemblies into partition systems, the assemblies include a number of factors which help in avoiding damage to the panels and thus enhance reuseability.

In addition, the partition systems employ hardware elements which are specifically designed to enhance moveability while at the same time providing protection to both the panels and to the floor and ceiling of the building.

Accordingly, in a first embodiment the invention provides a unitized panel assembly for partition walls comprising a frame structure comprising in open rectangular configuration top, bottom, and first and second sides each comprising a hollow member of rectangular configuration, each hollow member having first and second panel support faces joined by inner and outer webs, the faces having inner and outer surfaces and inner and outer edges, the outer web being spaced from the outer edges, the outer surfaces having a flange extending perpendicular thereto at the outer edges, a pair of rectangular panels secured to the support surfaces, and wherein the panels are adapted to fit closely within the flanges, and the extremities of the flanges are substantially flush with the outer surface of the panels.

In a further embodiment there is provided a unitized non-progressive partition system comprising a floor channel member adapted to be positioned on a floor, a ceiling channel member adapted to be secured to a ceiling, at least two juxtaposed unitized panel assemblies each comprising a frame structure comprising in open rectangular configuration top, bottom, and first and second sides each comprising a hollow member of rectangular configuration, each hollow member having first and second support faces joined by inner and outer webs, the faces having inner and outer surfaces and inner and outer edges, the outer web being spaced from the outer edges, the outer surfaces having a flange extending perpendicular thereto at the outer edges, a pair of rectangular panels secured to the support surfaces, and wherein the panels are adapted to fit closely within the flanges, and the extremities of the flanges are substantially flush with the outer surface of the panels, at least to height adjustment secured to the bottom of the frame structure and upon which the panel rests, the devices extending downwardly from the bottom of the panel such that, when positioned in the floor channel, the bottom of the panel is higher than the floor channel and the top of the panel is lower than the ceiling channel, and retractable means extending from the panel assembly to the ceiling channel for releasably supporting the panel assembly in an upright position.

In a further embodiment there is provided a method of constructing a unitized panel assembly for a partition wall comprising assembling an open rectangular frame consisting of a series of four hollow structural sections of substantially rectangular cross section joined at their ends along a forty-five degree lines of joining, each section including an internal channel therein, and wherein the frame is initially held in assembled position by ninety degree corner support members extending at the line of joining into adjacent channels, applying adhesive to the two panel supporting surfaces of the frame, placing a panel on each of the panel supporting surfaces, inserting the panel assembly into a compound press, activating the press to square and straighten the edges of the assembly and to apply pressure to the adhesive joints, allowing the adhesive to set, and removing the assembly from the press.

GENERAL DESCRIPTION

The panels of the present invention and the systems in which they are used were originally designed as a result of a perceived need in the refit situation. Even those original construction systems which were intended to be moveable were very limited in the configurations which could readily be rearranged, and the time and labour requirements was very high. Generally, as well, damage to walls and ceilings and to the panels themselves added to the problems.

Careful study of precisely those problems led to the development of the present invention. Among the specific design criteria, a primary factor was that the system must have unlimited versatility in terms of rearrangement, and that the effect of a partition on the permanent fixtures; i.e., the floors and ceilings, must be minimal.

The first cost, or original construction cost, of the system was then considered in order to ensure that the system would be cost competitive from that point of view. The panel assembly utilized in the system comprises a pair of conventional drywall panels secured to a frame. The frame is in an open rectangular configuration constructed from a formable material, preferably metal, to provide a pair of support surfaces between the two panels and to which the panels are secured, preferably by gluing. The frame is provided on each side with an overhanging flange around the edges which overhangs the edges of the respective panel and terminates flush with the outer surface of the panel. The edges of the panel are thus protected by the flange from the chipping and cracking to which they are normally susceptible.

The panel assemblies preferably include a pair of integral levelling feet, and a pair of vertically slidable locking devices at the top. These elements interact, as will be described, with floor and ceiling channels respectively to facilitate installation and to uniquely protect the panel assemblies during installation.

The invention includes a unique method of constructing the panels. In the preferred method the frame is initially split into four hollow structural members of rectangular cross section forming respectively top, bottom and two side members. These four components are mitred to fit together along forty-five degree lines of intersection at the corners. The frame members are held in place at the corner joints by ninety degree angle members fitted into channels within the adjacent frame members. The angle members are preferably secured in position by screws. A glue is applied to one of the support surfaces of the frame and/or to the corresponding surface of the panel. The two surfaces are brought together to form a first side of the panel assembly.

The first panel and the frame are then supported from beneath and the second panel is then joined in the same way to the other (top) side of the frame. The assembly is then placed in a press. The press acts on the glued surfaces to ensure a good joint but also acts on the edges of the assembly. The frame members are able to move under the influence of the press to ensure straight edges on the assembly.

When the glue has set, the panel assembly is removed from the press and is ready to receive hardware as required and to be incorporated into the partition system.

In addition to the basic panel assembly, various connectors along with ceiling and floor channels are required to complete the partition system.

The connectors and finishing strips are adapted to be joined in a smooth sliding friction fit that avoids particular points of resistance (e.g. snap fits) in insertion or removal. One exception is in the vertical adaptor strip that attaches directly to the sides of the panel assembly. This strip is preferably attached by a snap fit; although it may alternatively be permanently attached as by screws or the like.

The smooth friction fit is of particular importance to allow damage free removal of the various strips for refit purposes.

The ceiling and floor channels are preferably designed to have a minimum impact on the ceilings and floors. The ceiling channels in the preferred case are attached by clips to the T-bars of the suspended ceiling and are not in contact with the ceiling tiles. The clips include padded members which comprise the only contact with the exposed face of the T-bar. The T-bars are undamaged by the clips.

The floor channels are set onto "carpet grabbers" or else carpet grabbers are integral with the floor channels. Carpet grabbers consist of a number of protrusions under a support surface. The protrusions penetrate the carpet and rest against the floor to maintain the support surface at the level of the top of the carpet. Any crushing of the carpet is thereby avoided, and a partition wall resting on the support surface will not mar the carpet. In the preferred case the carpet grabbers are separate units to which the floor channels are attached as by two-sided tape.

The floor and ceiling channels include features which protect the panel assemblies and which contribute markedly to the ease of refit. In neither case are finishing strips an integral part of the channel. Rather, these strips are added to the wall as the final assembly step and are releasably secured by the smooth friction fit technique described above.

This arrangement is significant in terms of rearrangement of partitions in refit situations. For example, insertion or removal of a T-junction in a wall becomes complicated where the finishing strip or strips are integral with the channel or channels. In such cases a special T-junction channel section is normally required. It would generally be required to move all of the panel assemblies adjacent the junction in order to insert or remove the required modified channel. The additional labour adds to the expense and to the possibility of damage.

With the new system, the channel sections at a T-junction simply abut without modifications, so the finishing strip is removed, the necessary channel sections on the stem of the T added or removed and finishing strips reapplied. Only the panel assemblies to be added or removed need be touched.

The channel design, combined with the levelling feet and locking devices to which reference was made above, contributes in another way both to ease of assembly and to protection of the panels. The levelling feet raise the level of the bottom of the panel assembly above the channel, so that only the feet are within the channel.

At the same time the top of the panel assembly is delow the level of the ceiling channel. The slidable locking devices extend above the top of the panel assembly and engage the ceiling channel. The panel assembly is thus suspended between but does not itself engage the floor and ceiling channels. The finishing strips are applied by friction or pressure fit to the channels.

A panel assembly is installed by placing the feet in slidable positioning pads in the floor channel, tipping the assembly to the vertical, and sliding the locking devices upwardly into the ceiling channel.

Notably, at no time is the finished surface of the panel assembly pushed into a channel. This factor eliminates tearing or marring of the assembly finish and thus prolongs life expectancy, particularly in multiple refit situations.

As will be discussed in detail, the system readily accommodates glass panels, doors, and the like, all of which are modular in construction.

BRIEF DESCRIPTION OF THE DRAWINGS

In drawings which illustrate embodiments of the invention.

While the invention will be described in conjunction with the illustrated embodiments, it will be understood that it is not intended to limit the invention to such embodiments. On the contrary, it is intended to cover alll alternatives, modifications and equivalents as may be included within the spirit and scope of the invention as defined by the appended claims.

DETAILED DESCRIPTION OF THE PREFERRED EMBODIMENTS

Figure 1:
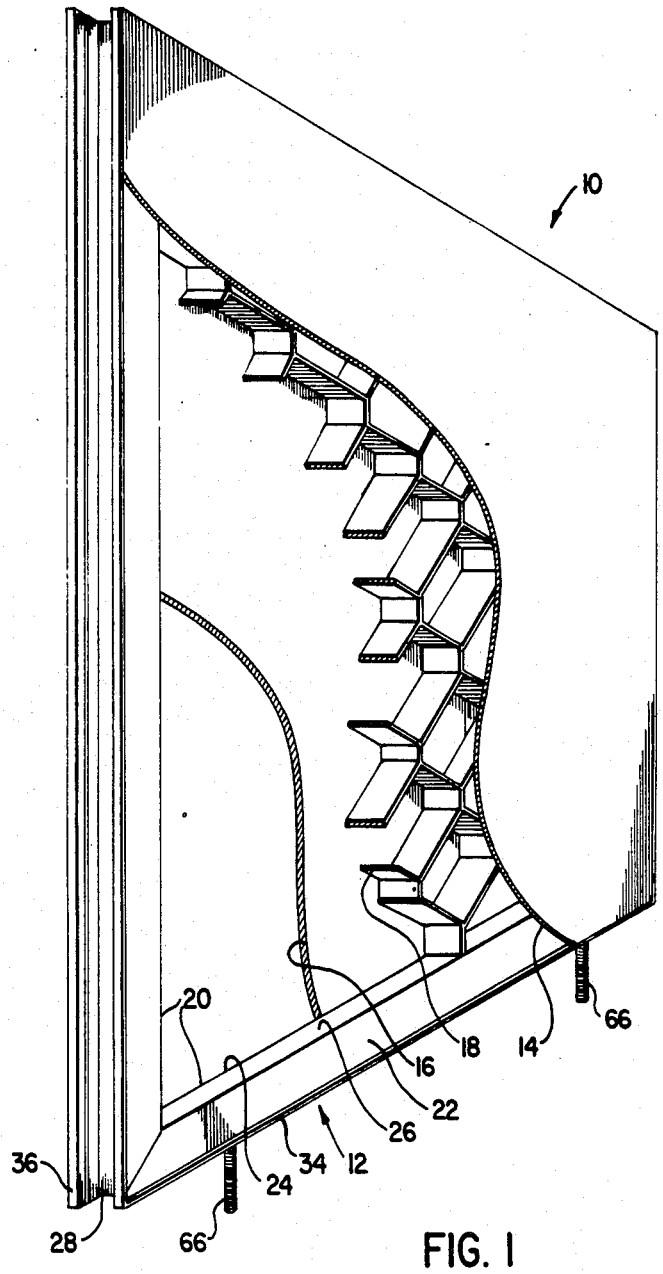
FIG. 1 is a partially cut away perspective view of a panel assembly according to the invention.
Figure 2:
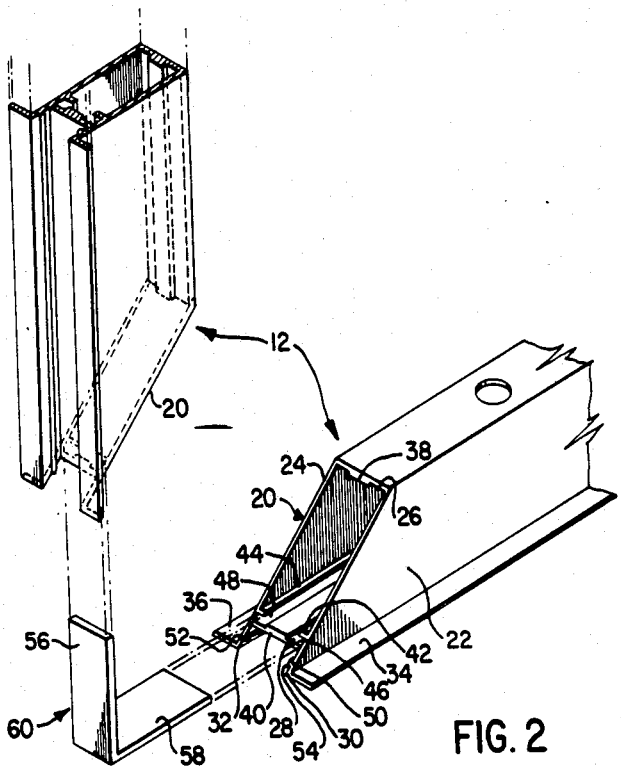
FIG. 2 illustrates detail of the frame construction in a panel assembly according to the invention.

FIGS. 1 and 2 illustrate general aspects of the basic panel assemblies according to the invention. The panel assembly 10 comprises an open rectangular frame 12 to opposite sides of which are attached the panels 14 and 16. Within the frame 12 and between the panels 14 and 16 there is illustrated a honeycomb 18 of corrugated paper.

The frame 12 comprises four hollow structural members 20 consisting of the first and second support surfaces 22 and 24 and inner and outer webs 26 and 28 respectively. The outer web 28 is spaced from the outer edges 30 and 32 of surfaces 22 and 24 respectively.

A pair of flanges 34 and 36 extend from and are perpendicular to the edges 30 and 32 respectively. The flanges 34 and 36 extend outwardly from the frame 12.

As illustrated, the frame 12 is preferably constructed of aluminum. The member 20 preferably includes reinforcement in webs 26 and 28. Such reinforcement is illustrated by the thickened regions 38 and 40.

The member 20 is provided internally with a pair of flanges 42 and 44 extending longitudinally of surfaces 22 and 24 and parallel to the thickened regions 38 and 40. These co-operate with the thickened regions 40 to form a slideway or channel 46.

A second pair of internal flanges 50 and 52 are located longitudinally of surfaces 22 and 24, and spaced from edges 30 and 32 and web 28. The extremities of flanges 50 and 52 are preferably rounded as at 54.

In constructing the basic panel assembly 10 the arms 56 and 58 of the angled member 60 are inserted into the channels 46 in adjacent ends of members 20, and the ends of members 20 are brought into abutment, and are held loosely in position. In the preferred case the members 60 are secured in place by screws passing through arms 56 and 58 and webs 40 and 38. Glue is applied to one of the surfaces 22 or 24 and/or to the corresponding area on the respective sheet 14 or 16. The first panel is set in place on the respective supporting surface, and the partial assembly is then laid flat with the first panel on the bottom. The interior space bounded by the frame members and the first panel may then be filled if required. As illustrated, a corrugated honeycomb filler 18 is inserted to add rigidity to the finished panel.

Other insulators or fillers may be used as required as, for example, sound insulators.

Glue is then applied, to the second side of the frame and/or to the correspdonding area on the respective panel 14 or 16. The panel is then placed in position on the frame.

The whole assembly is then placed in a press which acts in two ways on the assembly. Pressure is applied across the glued sections to ensure a good set and, at the same time, pressure is applied to the edges to straighten the assembly. The frame members are able to adjust out of any bowing or similar distortion by reason of applied pressure. Thus, once the glue is set, the assembly is both secure and squared.

The panels 14 and 16 utilized in the assemblies are preferably conventional gypsum board sheets, but any other suitable materials may be used.

Following construction of the assembly, the exposed panel surfaces are finished by the application of paint, wall covering or the like, the preferred material being vinyl wall covering.

Figure 3:
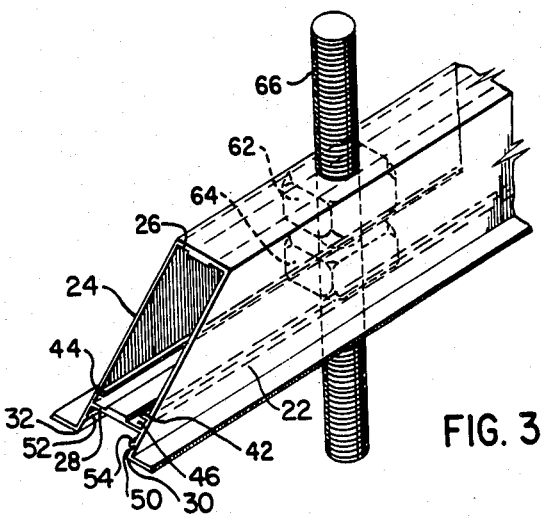
FIG. 3 illustrates a levelling device utilized in the panel assemblies according to the invention.

In the preferred case, prior to fabrication of the panel assembly, a pair of levelling devices are placed in the bottom frame member, as illustrated in FIG. 3. Vertically aligned pairs of holes are drilled through the webs 26 and 28. The nuts 62 and 64 are then slid into the interior of the member 12 with nut 62 adjacent web 26 and nut 64 adjacent flanges 42 and 44. The threaded support member 66 is then inserted through one of the pair of holes, rotated in threaded engagement through nuts 62 and 64 and finally through the second of the pair of holes.

When the panel assembly 10 is placed in position, as will be discussed below, the assembly rests on the supports 66. Height and levelling adjustments are effected by rotating the members 66. The rotation can conveniently be carried out simply by grasping the support 66 with pliers or the like.

Figure 4:
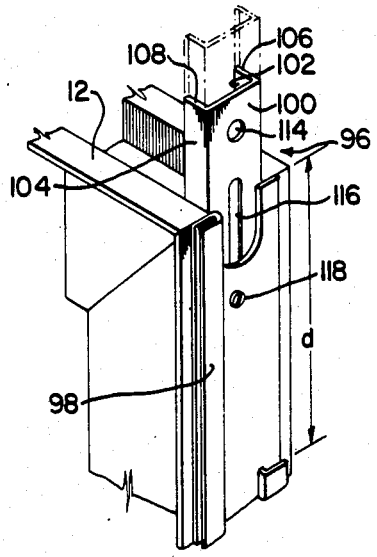
FIG. 4 illustrates detail of a retractable securing device used in the panel assemblies according to the invention.

The assembly 10 is also preferably provided with a retractable securing member 96. The construction of securing member 96 and its relation to the panel 10 is illustrated in FIG. 4. The adaptor strip 98 (described in detail below) cooperates with the frame 12 to firctionally position the member 96.

The member 96 is preferably a U-shaped channel section comprising the channel bottom 100 and the arms 102 and 104. In the preferred case the bottom 100 will have a slightly convex cross section. The arms 102 and 104 are of such a length that when the ends 106 and 108 respectively of arms 102 and 104 abut the web 28, the edges 100 and 112 will be approximately flush with the flanges 34 and 36. Accordingly, when the channel member 96 is inserted between the adaptor strip 98 and the web 28, there will be frictional resistance to longitudinal sliding of member 96.

The member 96 is provided toward the end thereof with an opening 114 into which a tool may be inserted to facilitate extension and retraction of the member 96.

In the preferred case means is provided by which to adjust the frictional force acting on the member 96. Thus in this situation the member 96 includes an elongated slot 116 extending longitudinally in the bottom 100 thereof. An adjusting screw 118 extends through the adaptor strip 98, through the slot 116 in the member 96 and finally through and in threaded engagement with the web 28 of frame 12. Tightening the screw 118 increases the resistance to longitudinal displacement of the member 96. The member 96 can thus be effectively locked in the extended position.

The portion "d" of the adaptor strip 98 has been modified to permit access to the head 120 of screw 118 in situations where the panel assembly is in position in a partition wall.

When assembled into a partition system, each panel assembly remains an independent unit which can be removed, reinserted, or the like without interference with adjoining panel assemblies. All adjustments, positioning, and securing of the assemblies are independent of adjoining assemblies. Interconnections between adjoining assemblies are for finishing purposes only and are not functional in positioning or the like.

Figure 5:
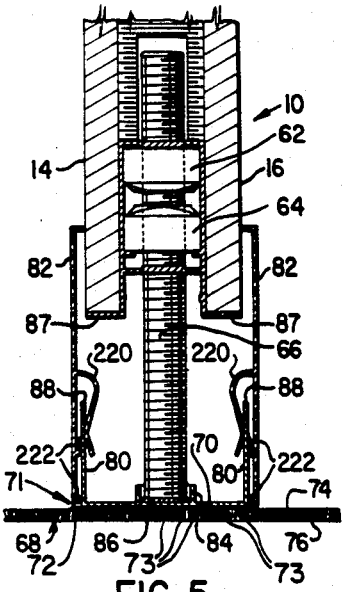
FIG. 5 illustrates the manner of securing panel assemblies according to the invention to a floor.

FIG. 5 illustrates the preferred manner of securing the panel assemblies 10 to the floor 68 in a partition system. A floor channel 70, preferably of extruded aluminum, is laid along the floor 68. The channel 70 preferably rests on a carpet grabber 71 comprising a platform 72 resting on a series of protrusions 73. The protrusions 73 penetrate the carpet 74 and rest on the unfinished floor 76 below carpet 74. The channel 70 is secured against lateral displacement by attachment to the platform 72 by two sided tape, adhesive, or the like. The protrusions 73 are preferably punched and bent from the platform 72 of the grabber 71. The protrusions 73 serve the dual function of establishing and maintaining the lateral position of channel 70 and of preventing crushing of the carpet 74. The latter function is of significant importance in enhancing moveability of the partitions, since it ensures that substantially no trace of a wall will remain on the floor carpet when the channel is removed.

The channel 70 preferably includes the upstanding outer parts 80 which serve as support members for finishing strips 82.

A subchannel 84 runs longitudinally down the channel 70 and serves as a lateral positioning channel for the supports 66. There are preferably within the subchannel 84 pads 86 which are slideable therein and upon which supports 66 rest.

The levelling support 66 will always be adjusted such that the bottom edge 87 of panel assembly 10 is above the level of the top edges 88 of channel parts 80.

This last factor contributes to the expected lifetime of the assembly 10 since it means that the channel sides 80 and the exposed surfaces of the panels 14 and 16 will not be in rubbing or other contact in construction of a wall or in subsequent use. This removes the problem, insofar as the bottom of the panel is concerned of marred finish normally associated with construction and demounting of partition walls.

It is notable that this advantage can only be gained where the finishing of trim strips 82 are separate from the channel 80.

Figure 6:
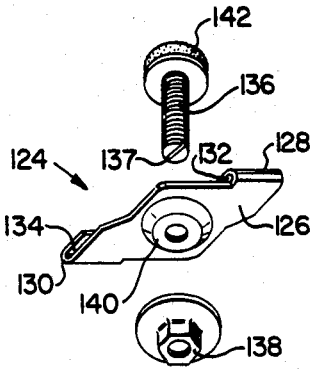
FIG. 6 illustrates a clip utilized in securing panel assemblies according to the present invention to a suspended ceiling.
Figure 7:
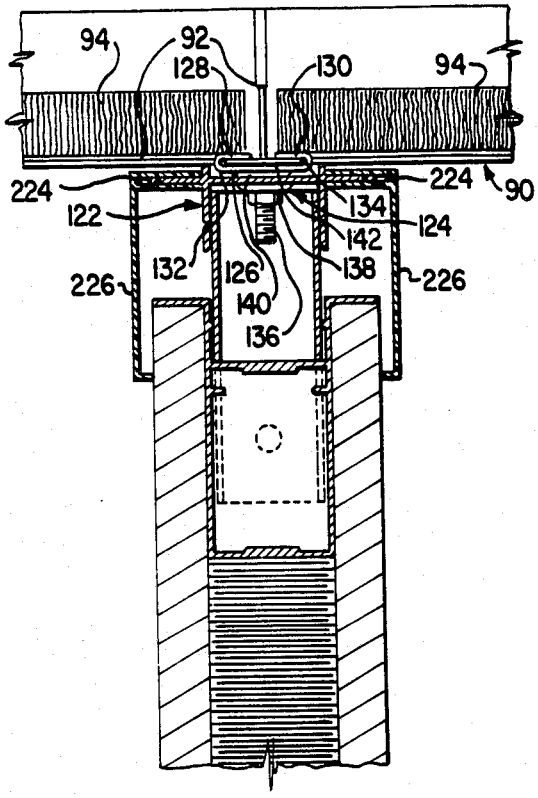
FIG. 7 illustrates the manner of securing panel assemblies according to the invention to a suspended ceiling.

FIG. 6 and 7 illustrtate the preferred manner of securing the panel assemblies 10 to the ceiling 90 in a partition system. Since the system of this invention is specifically designed for use with the suspended ceilings of modern commercial buildings, the ceiling 90 as illustrated consists of a suspended grid of T-bars 92 in combination with ceiling tiles 94.

For purposes of securing in positioning the top of a panel assembly 10, a ceiling channel 122 is secured to T-bar 92 by means of a series of clips 124. The clip 124 comprises a flat plate section 126 having a pair of projections 128 and 130 integral therewith and bent over to form a pair of parallel short channels 132 and 134. The said projections and channels are located diagonally from each other across plate 126. The channels 132 and 134 are spaced from each other such that when The clip is placed adjacent a T-bar and rotated, the channels receive the edges of the T-bar.

The clip 124 is maintained in position on the T-bar 92 by the bolt 136 acting in a threaded depression 140 in plate 126. A non-marking pad 142, preferably of felt, is secured to the top of bolt 136 by gluing. The pad 142 projects above the surface of the plate 126 and is the only contact of the clip 124 with the exposed surface of the T-bar 92.

In the preferred case the bolt 136 is provided with a slot 137 or similar means by which the bolt can be tightened to engage the padded top of the bolt 136 against the T-bar 92 and to thereby draw the sides of the channels 132 and 134 downward against the upper side of the T-bar.

The bolt 136 projects through a hole provided for the purpose in the ceiling channel 122 and the said channel is secured to the bolt 136 by the nut 138. As the nut 138 is tightened, the channel 122 abuts the depression 140 in the plate 126 and thereby secures the channel 122 to the clip 124 and also tends to restrain the plate 126 against rotation.

In the preferred case an insulating and padding strip 144 is interposed between the channel 122 and the T-bar 92. The strip in the area of clips 126 is located between the channel 122 and the plate 126.

In its most preferred format the basic panel assembly has thus been described as comprising the frame and panels structure, the adjusting feet, and the retractable securing devices. The assembly cooperates with floor and ceiling channels for positioning in a partition system.

Still in terms of a single panel assembly, the basic method of erecting a panel is to position a pair of slideable pads 86 in the subchannel 84 of floor channel 70. It should be noted that pads 86 are generally advantageous but not essential. The assembly 10 is then positioned in the floor channel 70 with the supports 66 resting on pads 84. The assembly 10 is then moved to the vertical position with the retractable members 96 in the retracted position and the top of the assembly aligned with ceiling channel 122. The members 96 are then extended up into the channel 122 to secure the assembly in the vertical position.

It is a very significant aspect of the relationship between the panel assemblies and the channels that the height of the panel assemblies is less than the distance between the floor and ceiling channels and that the supports 66 maintain the bottom of the panel assembly above the top of the floor channel. The panel assembly is thus suspended between the two channels with contact only through supports 66 and retractable devices 96. There is therefore eliminated the problem of scraping or tearing of the panel skin during insertion or removal to or from the system. This factor adds substantially to the life expectancy of the panels.

The following discussion relates to the use of the basic assembly 10 as part of a partition system. Having described the basic panel assemblies and the mounting channels, there remains for discussion the manner of establishing joints between the individual assemblies, and the manner of affixing various finishing strips.

Figure 8:
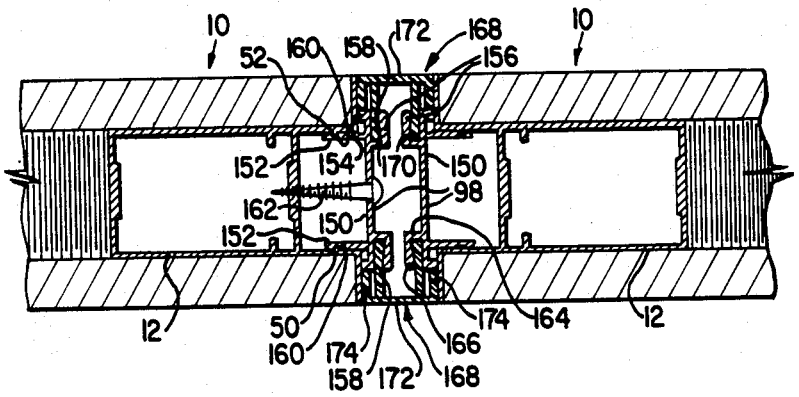
FIG. 8 illustrates one manner of concealing or finishing the space between two adjacent panel assemblies.

FIG. 8 illustrates a pair of panel assemblies 10 joined in a basic straight wall configuration. The key to constructing and finishing the joint lies in the adaptor strips 98. In the simplest case the strip 98 extends along the two vertical edges of the standing panel assembly from top to bottom thereof. Optionally these strips may be integral with the frame 12.

In its basic format the strip 98 consists of a flat section 150 from which extends a pair of legs 152, a pair of shorter legs 154 and a pair of designed protrusions 156. Protrusions 156 form with the section 150 a pair of channels 158.

Each of legs 152 preferably includes a longitudinal groove 160 which mates with a corresponding flange 50 or 52 on frame 12. The strip 98 can thus be snapped into position on the edge of frame 12. Since the strip 98 is in most cases a permanent attachment to the panel assembly, the snap action joint, which requires a reasonably substantial degree of force for disassembly, is acceptable. In addition, a series of screws 162 may be used to secure strip 98 to the frame 12. This is in marked contrast to the manner of attachment of various finishing strips.

The protrusions 156 extend in two parts from the flat section 150 of the strip 98. The first part 164 is perpendicular to the section 150 and the second part 166 is generally parallel to section 150. The specific configuration of the protrusions 156 is, however, of less importance than the functional limitation. That highly preferred limitation is that the channels 158 be such as to avoid any snap fastening with a cooperating finishing strip 168, but to provide instead a smooth and continuous application of pressure during insertion and retention of such a strip 168. This preferred situation is again related to the moveability of the system.

The finishing strip 168 will be subject to removal whenever an associated panel assembly is removed, and in this way contrasts with the semi-permanent attachment of the strip 98. In order to avoid damage during repeated removal and reinsertion of strip 168, and to permit the use of a vinyl or the like strip with little strength, the continuous smooth pressure is highly advantageous. The use of this method adds to the life expectancy of the finishing strips 168, as well as the adaptor strips 98.

As illustrated in FIG. 8 the part 166 of protrusion 156 is somewhat bulbous in configuration, and the bulbous aspect is elongated to avoid any sharp transition in contour along the length of the part.

The cooperating finishing strip 168 includes a pair of cooperating arms 170 which have a similar bulbous configuration and which can be inserted smoothly into the channels 158 and similarly withdrawn with little stress on the arms 170 or the parts 166.

As illustrated in FIG. 8, the finishing strip 168 includes a flat outer section 172 from which depend the arms 170 and a pair of shorter arms 174 the latter of which, when the strip 168 is in place, bring up against the legs 154. The arms 174 add stability to the strip 168 when in place. As is the case with the strip 98 and the protrusions 156, the specific configuration of the strip 168 as a whole is of substantially less significance than is the configuration of the arms 170, these last preferably being designed to meet the functional requirement discussed above of smooth even application of pressure. The particular bulbous configuration illustrated actually draws the strip 168 into position and continually exerts pressure to hold the strip firmly in place.

In the preferred case, the strip 98 is an aluminum extrusion, the strip 168 is a vinyl extrusion, and the exposed surface 172 of strip 98 is finished to match the finished surface of the panel assembly 12.

A further significant aspect of the panel assembly interconnection just described is that the finishing strip 168 is present for purely aesthetic reasons and performs no function in positioning the panel assemblies 12 or maintaining them in position. The assemblies are positioned by sliding them along the pads 86 floor channel 70 and by adjusting the supports 66. This factor contributes to the fact that the strip 168 can be of relatively flimsy construction and so of very low cost. This cost saving is substantial. As well, the total structural independence of the unitized panel assemblies means that they can be manipulated individually in a partition system without disturbing neighbouring assemblies.

Figure 9:
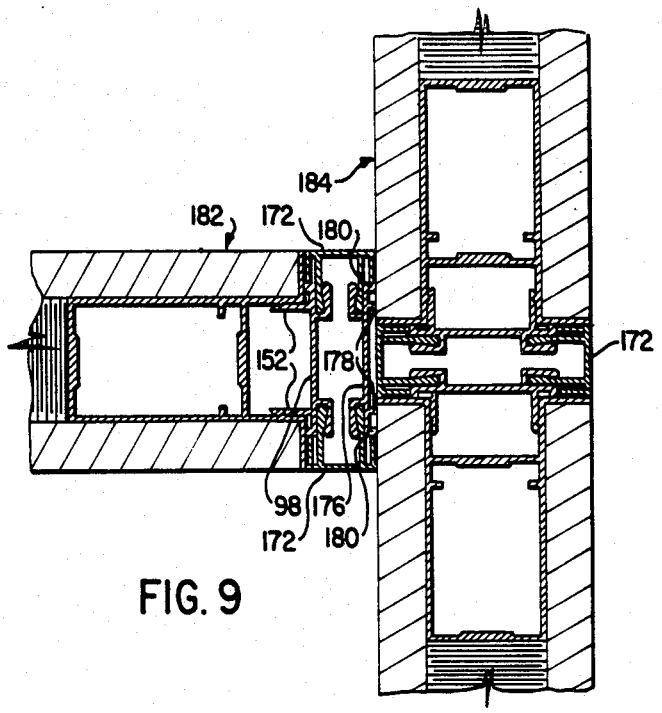
FIG. 9 illustrates one manner of finishing a T-junction between panel assemblies according to the invention.
Figure 10:
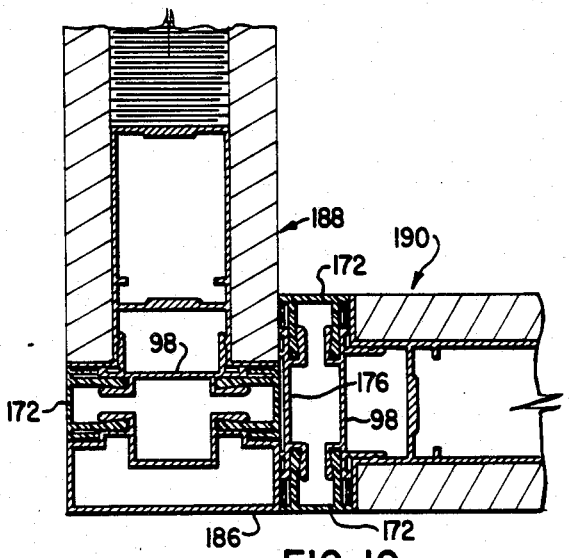
FIG. 10 illustrates one manner of finishing a ninety degree corner between panel assemblies according to the invention.
Figure 11:
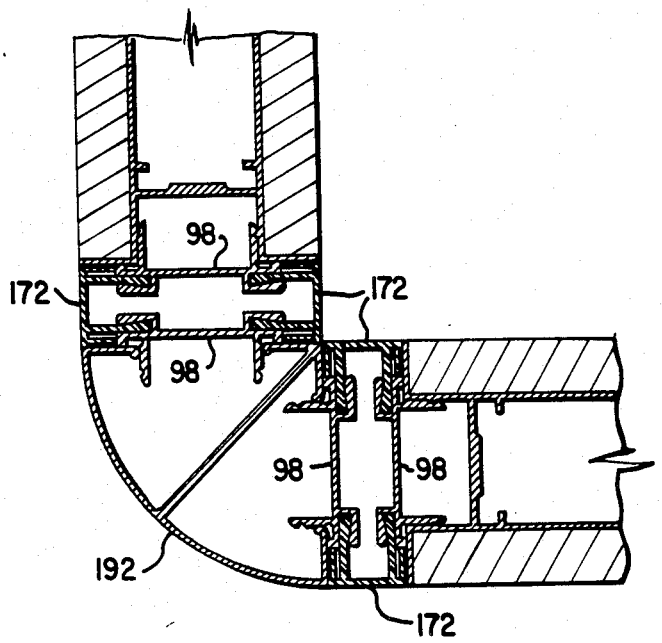
FIG. 11 illustrates a second manner of finishing a ninety degree corner between panel assemblies according to the invention.

Subsequent figures illustrate detail of additional aspects of the system. FIGS. 9, 10 and 11 show respectively a T-intersection, a squared ninety degree intersection and a round ninety degree intersection between panel assemblies. In each case there are minor variations from the basic one hundred eighty degree joint discussed above. With reference to FIG. 9, the adaptor strip 176 differs from the basic strip 98 in that the legs 178 are shortened as compared with legs 152 in strip 98. The legs 178 and the legs 180 of strip 176 are of equal length and abut against the surface with which wall section 182 intersects. As illustrated, the wall section 182 abuts wall section 184 across a joint, but since there is no actual connection between the two wall sections, the T-intersection could be placed as desired at any port along wall section 184.

The ninety degree intersection illustrated in FIG. 10 utilizes only one additional component from the T-intersection of FIG. 9. The finished end cap 186 terminates a straight run of wall, as 188, and the ninety degree run of wall 190 is then simply added in the same manner as in the T-intersection case.

A rounded ninety degree intersection is illustrated in FIG. 11. In this case only the corner strip 192 is required in addition to the basic components. The standard adaptor strips 98 cooperate with the corner strip 192 to form something of a corner post unit.

In FIGS. 10 and 11, the exposed surface of the end cap 186 and corner strip 192 respectively will normally be finished to match the adjacent walls.

Figure 12:
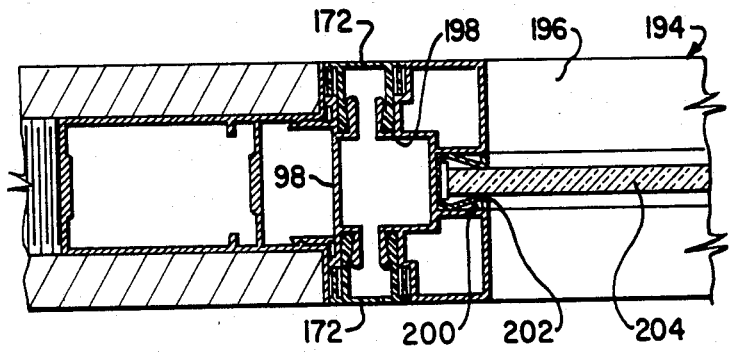
FIG. 12 illustrates the construction of a glass panel assembly for use in the system according to the invention.

FIG. 12 illustrates a variation in the system in which a glass panel assembly 194 is utilized in place of the basic plaster board one. A modified frame 196 is utilized for this purpose which has integral therewith the structure 198 which incorporates the features of the adaptor strip 98. The frame 196 includes a channel 200 which in turn receives therein a glazing channel 202. The glass panel 204 is held within the channel 202.

Figure 13:
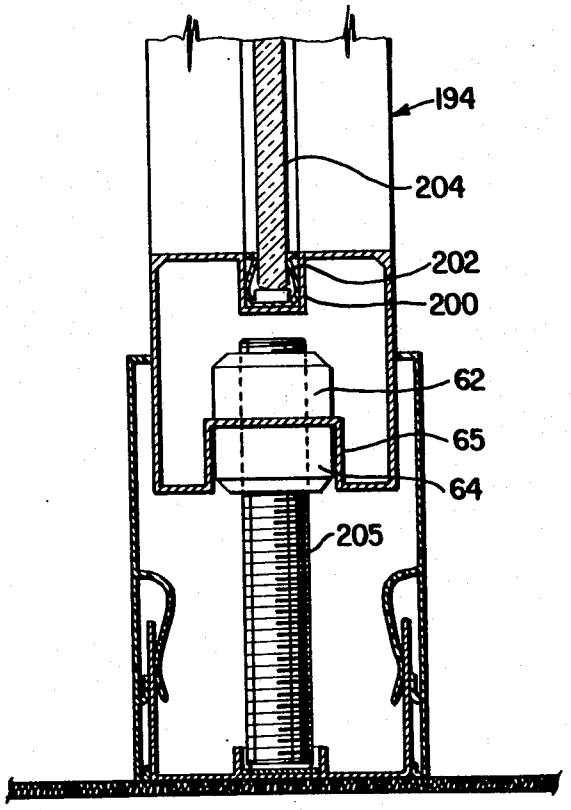
FIG. 13 illustrates a floor channel arrangement for the panel assembly of FIG. 12.

FIG. 13 illustrates a modified adjustable panel support 205 which varies only slightly from support 66 of FIG. 5. In this case the nut 63 can optionally be omitted and the nut 64 braced in channel 65.

The ceiling attachment in the case of the glass containing panels is essentially the same as that for the regular panels illustrated in FIGS. 6 and 7.

Figure 14:
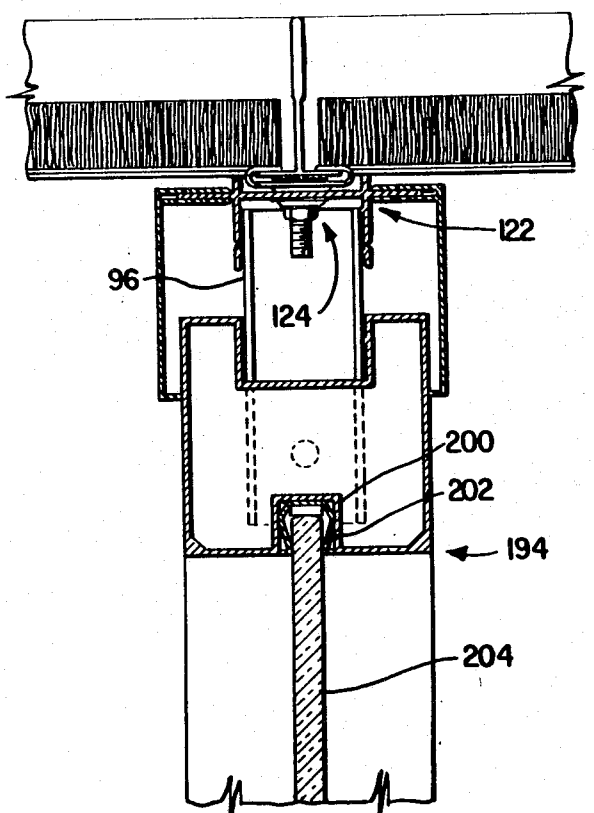
FIG. 14 illustrates a ceiling channel arrangment for the panel assembly of FIG. 12.

FIG. 14 illustrates the manner of joining a glass panel assembly 194 to a ceiling channel 122. This is essentially the same as that illustrated in FIG. 7 for the standard panel.

Figure 15:
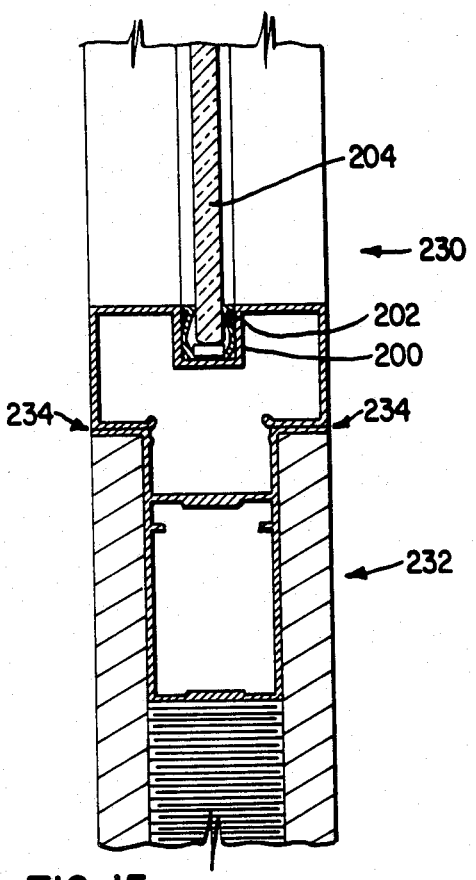
FIG. 15 illustrates a panel assembly for use in the partition system of the invention in which the assembly is partly solid and partly glass.

FIG. 15 illustrates an assembly in which a part 230 of the panel is of glass and part 232 is of standard plaster board. The two sections may be screwed or welded together at 234.

Figure 16:
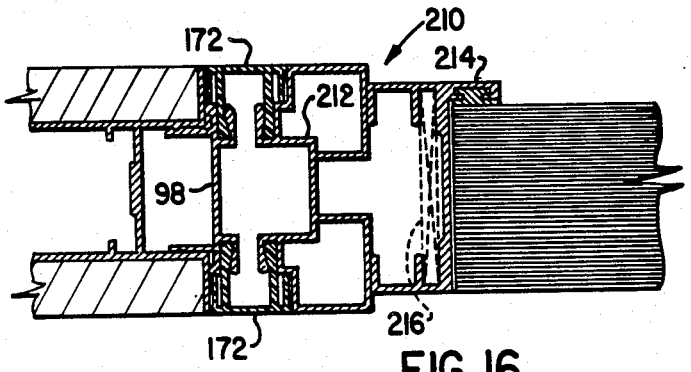
FIG. 16 illustrates a construction for inserting a door into the panel assemblies of the invention.

FIG. 16 illustrates one format for placing a door in the partition system. The frame 210 is similar to the frame 196 utilized in the glass panel situation, in that the adaptor strip 212 is integral, but is modified to receive the door jamb structure 214. Reinforcement 216 is included to accommodate the stress of the hinges and hanging door.

Floor and ceiling finishing strips are illustrated in FIGS. 5 and 7. Since the floor channel 70 and the ceiling channel 122 generally remain unchanged in the various configurations of the system, the finishing strips similarly serve all variations.

With reference to FIG. 5, the finishing strips 82 include the clips 220 and the supports 222 by which strips 82 can be clipped to the upstanding parts 80 of channel 70.

Similarly, referring to FIG. 7, the ceiling channel 122 includes the wing members 224 to which are clipped the finishing strips 226. The strips are relatively lightly secured by a friction fit.

All intersections, corners and the like can be accommodated by appropriate cutting of the floor and ceiling channels and finishing strips. This avoids situations common in some systems where, for example, corner channels, T-channels and the like are utilized. In those prior art situations the flexibility of the system is hampered because the panel assemblies are not independently moveable into other configuratons. For example, in order to remove a ninety degree corner condition, it might be necessary to remove both adjacent panel assemblies leading to the corner, remove the corner channel, insert the new channel, and reinstall the two assemblies. These types of problems are avoided in the present case. Similar advantages are obtained because the finishing strips are not integral with the channels at either floor or ceiling.

Thus it is apparent that there has been provided in accordance with the invention unitized panel assemblies for partition walls and partition system using the panel assemblies that fully satisfy the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What we claim as our invention:

1. A unitized panel for partition walls comprising:

a frame structure comprising in open rectangular configuration top, bottom, and first and second sides each comprising a hollow member of rectangular configuration, each said hollow member having first and second panel support faces joined by inner and outer webs, said faces having inner and outer surfaces and inner and outer edges, said outer web being spaced from said outer edges, said outer surfaces having a flange extending perpendicular thereto at the said outer edges;

a pair of rectangular panels secured to said support surfaces; and wherein said panels fit closely within said flanges, and the extremities of the flanges are substantially flush with the outer surface of the panels.

2. The panel assembly of claim 1 wherein said panels are secured to said support surfaces by means of an adhesive.

3. The panel assembly of claim 1 wherein each said hollow member includes an internal channel extending longitudinally between said inner and outer webs and wherein said frame structure includes a member at each corner thereof secured in and extending from one said internal channel of one said hollow member to the said internal channel of said adjacent member to thereby secure said hollow members together.

4. The assembly of claim 1 wherein the said frame structure is composed of aluminum extrusions.

5. The assembly of claim 1 wherein the said panels are gypsum board sheets.

6. The panel assembly of claim 1 wherein the space bounded by the said two panels and the said inner web is filled with an insulating material.

7. The assembly of claim 1 including at least one levelling device associated with the bottom of said assembly, said at least one device comprising at least one member having an internally threaded opening therethrough located in and secured against rotation in said bottom hollow member, and an elongated externally threaded member passing through openings provided in said webs of said bottom and in threaded engagement with said internally threaded opening.

8. The assembly of claim 7 including two said levelling devices, wherein each said device includes two said members having internally threaded openings, and wherein in each said device said elongated externally threaded member threadedly engages both of said internally threaded openings.

9. The panel assembly of claim 1 wherein the space bounded by the said two panels and the said inner web is filled with a stiffening material.

10. The assembly of claim 9 wherein the said stiffening material is a honeycomb of corrugated paper.

11. The assembly of claim 1 including an adaptor strip secured along at least one of said first and second sides, said adaptor strip including means for securing finishing strips to said assembly.

12. The assembly of claim 11 wherein said frame structure includes a pair of longitudinally extending bead flanges located on the inner surfaces of said support members between the said outer web and the said edges of said support members, and wherein said adaptor strip includes a pair of legs running longitudinally of said strip, each said leg having a longitudinal groove therein which grooves engage respective ones of said flanges to secure said strip to said assembly.

13. The assembly of claim 1 including a pair of vertically slidable members, one associated with the top of each said side, said members located in a channel formed by said outer web and said support surfaces, and wherein said members are slidable between an extended position in which part of said members extend beyond said top and a retracted position in which said members are located below said top.

14. The assembly of claim 13 wherein said slideable members are in frictional engagement with said support surfaces.

15. The assembly of claim 14 wherein said slideable member includes a longitudinal slot therein and wherein said assembly includes a screw, the threaded portion of which passes through said slot and threadedly engages said outer web and the head of which abuts against said slideable member, whereby adjustment of said screw serves to lock or free said slideable member.

16. A unitized non-progressive partition system comprising:

(a) a floor channel member adapted to be positioned on a floor;

(b) a ceiling channel member adapted to be secured to a ceiling;

(c) at least two juxtaposed unitized panel assemblies each comprising:

a frame structure comprising in open rectangular configuration top, bottom, and first and second sides each comprising a hollow member of rectangular configuration, each said hollow member having first and second panel support faces joined by inner and outer webs, said faces having inner and outer surfaces and inner and outer edges, said outer web being spaced from said outer edges, said outer surfaces having a flange extending perpendicular thereto at the said outer edges;

a pair of rectangular panels secured to said support surfaces; and wherein said panels are adapted to fit closely within said flanges, and the extremities of the flanges are substantially flush with the outer surface of the panels;

at least two height adjustment devices secured to the bottom of said frame structure and upon which said panel rests, said devices extending downwardly from the bottom of said panel such that, when positioned in said floor channel, the bottom of the panel is higher than said floor channel and the top of said panel is lower than said ceiling channel;

(d) rectractable means extending from said panel assembly to said ceiling channel for releasably supporting said panel assembly in an upright position.

17. The partition system of said claim 16 wherein the vertical edges of the juxtaposed assemblies include adaptor strips having channels running longitudinally therein for receiving in frictional engagement cooperating parts of a finishing strip.

* * * * *